US010593313B1

(12) United States Patent
Bacigalupo

(10) Patent No.: US 10,593,313 B1
(45) Date of Patent: Mar. 17, 2020

(54) PLATTER BASED ELECTRONIC MUSICAL INSTRUMENT

(71) Applicant: Peter Bacigalupo, Nashville, TN (US)

(72) Inventor: Peter Bacigalupo, Nashville, TN (US)

( * ) Notice: Subject to any disclaimer, the term of this patent is extended or adjusted under 35 U.S.C. 154(b) by 0 days.

(21) Appl. No.: 16/276,341

(22) Filed: Feb. 14, 2019

(51) Int. Cl.
*G10H 1/06* (2006.01)
*G10H 1/34* (2006.01)
*G10H 1/00* (2006.01)

(52) U.S. Cl.
CPC ..... *G10H 1/06* (2013.01); *G10H 1/0008* (2013.01); *G10H 1/0066* (2013.01); *G10H 1/34* (2013.01); *G10H 2210/561* (2013.01)

(58) Field of Classification Search
CPC ..... G10H 1/06; G10H 1/0008; G10H 1/0066
USPC ..... 84/609
See application file for complete search history.

(56) References Cited

U.S. PATENT DOCUMENTS 2,138,875 A 12/1938 Miessner ..... 369/53.39
2,924,138 A 2/1960 Jones ..... 369/18
4,300,225 A 11/1981 Lambl ..... 369/2
5,067,119 A 11/1991 Yoshida et al. ..... 369/47.12
5,248,845 A 9/1993 Massie et al. ..... 84/622
5,302,777 A * 4/1994 Okuda ..... G10H 1/36 84/637
5,303,309 A 4/1994 Rossum ..... 381/118
5,339,301 A 8/1994 Raaymakers et al. ..... 369/47.12
5,342,990 A 8/1994 Rossum ..... 84/603
5,350,882 A 10/1994 Koguchi et al. ..... 84/636
5,353,275 A 10/1994 Almonte ..... 369/189
5,525,749 A * 6/1996 Aoki ..... G10H 1/0025 84/609
5,602,356 A 2/1997 Mohrbacher ..... 84/609
5,609,486 A 3/1997 Miyashita et al. ..... 434/307 A
5,650,584 A * 7/1997 Shinsky ..... G10H 1/0025 84/613
5,698,803 A 12/1997 Rossum ..... 84/607
5,698,807 A 12/1997 Massie et al. ..... 84/661
5,777,251 A * 7/1998 Hotta ..... G10H 1/0008 84/609
5,862,106 A 1/1999 Washikawa et al. ..... 363/30.13
5,895,876 A 4/1999 Moriyama et al. ..... 84/609
5,925,841 A 7/1999 Rossum ..... 84/603
6,057,503 A * 5/2000 Shinsky ..... G10H 1/0025 84/613
6,100,462 A * 8/2000 Aoki ..... G10H 1/0025 84/613
6,137,043 A 10/2000 Rossum ..... 84/603
6,156,966 A * 12/2000 Shinsky ..... G10H 1/0025 84/613

(Continued)

FOREIGN PATENT DOCUMENTS

WO WO97/01168 1/1997 ..... G10H 1/00

*Primary Examiner* — David S Warren
(74) *Attorney, Agent, or Firm* — Pitchford Fugett, PLLC; Mark A. Pitchford; Eric B. Fugett

(57) ABSTRACT

A platter based electronic musical instrument is operable to shift the frequency of a sound sample as a function of a rotational position of the platter and a scale selection signal. The electronic musical instrument is further operable to render the frequency shifted sound sample. A scale of the electronic musical instrument is selected via a leash. The leash determines the selected scale of the electronic musical instrument as a function of input provided by (e.g., a chord played on) a controlling musical instrument.

13 Claims, 5 Drawing Sheets

(56) References Cited

U.S. PATENT DOCUMENTS 6,365,816 B1 4/2002 Rossum ..... 84/603
6,379,244 B1 4/2002 Sagawa et al. ..... 463/7
6,441,289 B1 * 8/2002 Shinsky ..... G10H 1/0025 84/464 R
6,448,486 B1 * 9/2002 Shinsky ..... G10H 1/0025 84/613
6,541,690 B1 4/2003 Segers, Jr. ..... 84/605
6,545,953 B1 4/2003 Herbert ..... 369/4
6,576,825 B2 6/2003 Yamada et al. ..... 84/602
6,687,193 B2 2/2004 Jung ..... 369/4
6,818,815 B2 11/2004 Cohen ..... 84/645
6,858,790 B2 2/2005 Rossum ..... 84/603
6,881,949 B2 4/2005 Spencer ..... 250/231.13
6,961,289 B2 11/2005 Liu ..... 369/4
7,010,371 B2 3/2006 Liu ..... 700/94
7,012,184 B2 3/2006 Bastian ..... 84/612
7,041,892 B2 5/2006 Becker ..... 84/603
7,087,830 B2 8/2006 Kent et al. ..... 84/645
7,115,807 B2 10/2006 Yamada et al. ..... 84/602
7,208,670 B2 * 4/2007 Sim ..... G10H 1/34 84/609
7,218,578 B2 5/2007 Usui ..... 369/30.27
7,235,732 B2 6/2007 Becker ..... 84/602
7,238,874 B2 7/2007 Bastian ..... 84/612
7,273,980 B2 9/2007 Wardle ..... 84/645
7,514,622 B2 4/2009 Yoshikawa ..... 84/609
7,566,827 B2 7/2009 Mazur et al. ..... 84/723
7,592,534 B2 9/2009 Yoshikawa et al. ..... 84/612
7,615,702 B2 11/2009 Becker et al. ..... 84/612
7,683,249 B2 3/2010 Becker ..... 84/602
7,763,843 B2 7/2010 Flum et al. ..... 250/231.18
7,787,342 B2 8/2010 Yamada et al. ..... 369/53.37
7,889,605 B2 2/2011 Yamada et al. ..... 369/30.18
7,928,313 B2 4/2011 Flum et al. ..... 84/723
7,964,782 B2 6/2011 Liu ..... 84/600
7,999,167 B2 8/2011 Yoshikawa et al. ..... 84/600
8,053,660 B2 11/2011 Flum et al. ..... 84/725
8,077,568 B2 12/2011 Spencer ..... 369/47.35
8,110,734 B2 2/2012 Flum ..... 84/615
8,116,892 B2 2/2012 Huang ..... 700/94
8,153,881 B2 4/2012 Coppard et al. ..... 84/615
8,153,883 B2 4/2012 Flum et al. ..... 84/743
8,217,252 B2 7/2012 Bastian ..... 84/612
8,314,321 B2 11/2012 Wun et al. ..... 84/615
8,362,349 B2 1/2013 Mazur et al. ..... 84/723
8,502,058 B2 8/2013 Bastian ..... 84/612
8,642,875 B2 * 2/2014 Kinter ..... G10H 1/38 84/619
8,729,375 B1 * 5/2014 Bacigalupo ..... G10H 1/02 84/615
8,802,955 B2 * 8/2014 Bergman ..... G10H 1/38 84/613
9,153,219 B1 * 10/2015 Bacigalupo ..... G10H 1/02
10,269,335 B1 * 4/2019 O'Hair ..... G10H 1/344
10,319,354 B2 * 6/2019 Laughlin ..... G10H 1/0016
2002/0029685 A1 * 3/2002 Aoki ..... G10H 1/38 84/613
2002/0176327 A1 11/2002 Yamada et al. ..... 369/30.26
2002/0194976 A1 12/2002 Rossum ..... 84/1
2003/0029305 A1 2/2003 Kent et al. ..... 84/645
2003/0167907 A1 9/2003 Annen ..... 84/615
2004/0069127 A1 4/2004 Ludwig ..... 84/645
2004/0177746 A1 9/2004 Becker ..... 84/612
2005/0081699 A1 4/2005 Becker ..... 84/604
2005/0152236 A1 7/2005 Wardle ..... 369/39.01
2006/0000345 A1 1/2006 Yoshikawa ..... 84/616
2007/0131100 A1 6/2007 Daniel ..... 84/747
2007/0227337 A1 10/2007 Yoshikawa et al. ..... 84/602
2008/0148922 A1 6/2008 Morra ..... 84/600
2008/0156180 A1 7/2008 Bagale ..... 84/743
2008/0212437 A1 9/2008 Kataoka et al. ..... 369/53.41
2009/0324192 A1 12/2009 Ogura et al. ..... 386/66
2011/0094369 A1 4/2011 Liu ..... 84/645
2013/0305906 A1 * 11/2013 Kinter ..... G10H 1/38 84/613
2016/0148606 A1 * 5/2016 Minamitaka ..... G10H 1/0025 84/609

* cited by examiner

PLATTER BASED ELECTRONIC MUSICAL INSTRUMENT

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to electronic musical instruments and methods of playing electronic musical instruments. More particularly, this invention pertains to a platter (e.g. turntable) based electronic musical instrument.

Despite advances in electronics and music, new musical instruments are rarely introduced. The Theremin is one of the only true electronic musical instruments, but its limited sound and constant output reduce it to a novelty rather than a respected musical instrument. Other electronic musical instruments include keyboards and electric guitars, but these instruments only mimic prior acoustic instruments.

Platter based electronic instruments were introduced to the market in about 2016. They have been moderately successful, but DJ's (i.e., disc jockeys) often have trouble with playing in the correct key. Musicians from other backgrounds usually require substantial time and practice to adapt to the platter based controls, but have less trouble selecting and playing in the correct key.

BRIEF SUMMARY OF THE INVENTION

Aspects of the present invention provide a platter based electronic musical instrument operable to shift a frequency of a sound sample as a function of a rotational position of the platter and a scale selection signal. The electronic musical instrument is further operable to render the frequency shifted sound sample. A scale of the electronic musical instrument is selected via a leash. The leash determines the selected scale of the electronic musical instrument as a function of input provided by (e.g., a chord played on) a controlling musical instrument.

In one aspect, a leash for a platter based electronic musical instrument includes an input, a translator, and an output. The electronic musical instrument is responsive to a scale selection signal to shift the frequency of a sound sample as a function of a rotational position of a platter of the electronic musical instrument and the scale selection signal. The input is operable to receive an input signal from a controlling musical instrument and provide a cord signal indicative of a chord played on the controlling musical instrument. The translator is operable to receive the cord signal from the input and select a scale corresponding to accord represented by the cord signal. The output is operable to provide a scale selection signal to a processor of the electronic musical instrument representative of the selected scale.

In another aspect, an electronic musical instrument includes a platter, a rotational position sensor, a buffer, a processor, and a leash. The platter is operable to rotate about a center point, wherein the platter is further operable to be rotated by a user. The rotational position sensor is operable to sense rotation of the platter and provide a position signal indicative of the sensed rotation of the platter. The buffer is operable to store a sound sample. The processor is operable to determine rotational position of the platter as a function of the position signal, retrieve the sound sample from the buffer, shift a frequency of the sound sample as a function of the determined rotational position of the platter, and render the frequency shifted sound sample. The leash includes an input, a translator, and an output. The input is operable to receive an input signal from a controlling musical instrument and provide a cord signal indicative of a chord played on the controlling musical instrument. The translator is operable to receive the cord signal from the input, determine, based on the received cord signal, a plurality of notes played on the controlling musical instrument, and select a scale corresponding to the determined plurality of notes played on the controlling musical instrument. The output is operable to provide a scale selection signal to the processor of the electronic musical instrument based on the selected scale. The processor is further operable to receive the scale selection signal and shift the frequency of the sound sample as a function of the selected scale and the determined rotational position of the platter.

In another aspect, a method of operating an electronic musical instrument includes receiving an input signal from a controlling musical instrument at an input of a leash. An output of the leash provides a scale selection signal to a processor of the electronic musical instrument as a function of the input signal. The electronic musical instrument renders a frequency shifted sound sample. A frequency shift of the frequency shifted sound sample is determined by the processor as a function of a rotational position of a platter of electronic musical instrument and the scale selection signal.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figure 1:
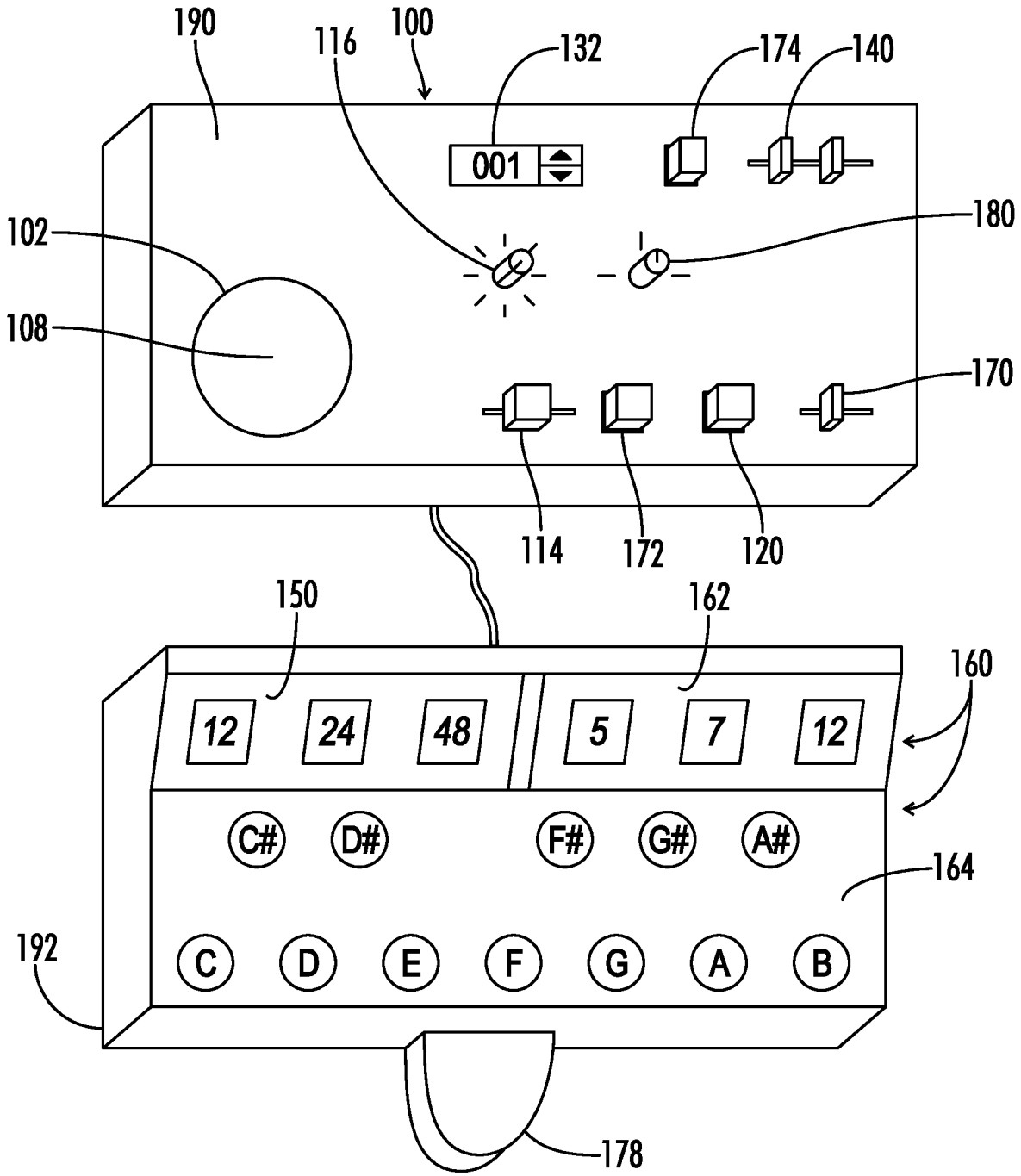
FIG. 1 is an isometric view of an electronic musical instrument.
Figure 2:
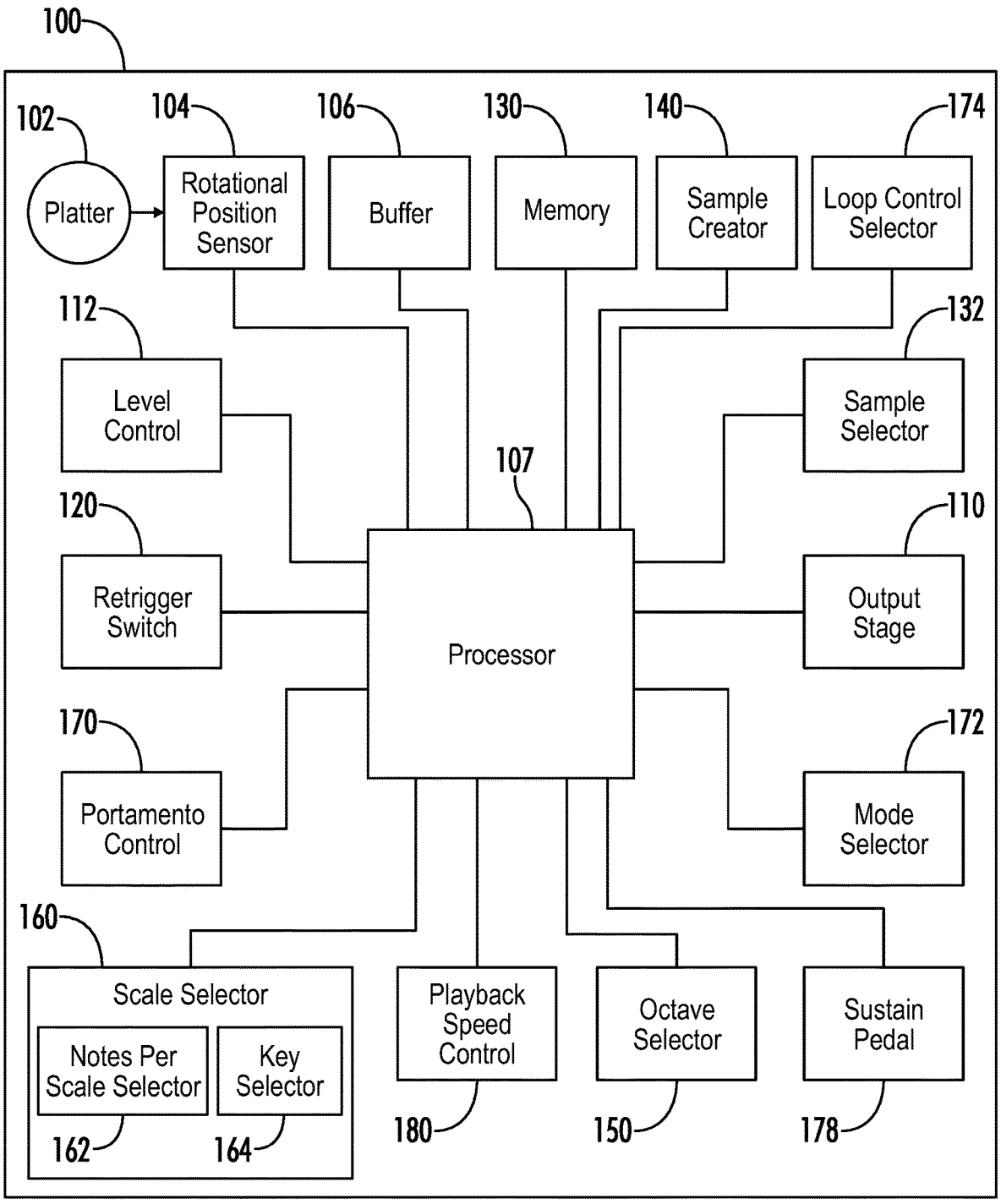
FIG. 2 is a block diagram of an electronic musical instrument.
Figure 3A:
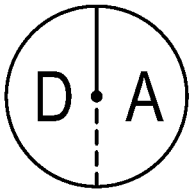
FIG. 3A is a diagram of logical divisions of a platter of the musical instrument showing two divisions per octave and a single octave per rotation.

Referring to FIGS. 1 and 2, an electronic musical instrument 100 includes a platter 102, a rotational position sensor 104, a buffer 106, and a processor 107. The platter 102 is operable to rotate about a center point 108 and is operable to be rotated by the user (i.e., operator or player) of the musical instrument 100. The rotational position sensor 104 is operable to sense rotation of the platter 102 and provide a position signal indicative of the sense rotation of the platter to the processor 107. The buffer 106 is operable to store a sound sample. The processor 107 is operable to receive the position signal from the rotational position sensor 104. Although the platter 102 rotates about the center point 108, the center point 108 is not indicative of a spindle system. It is contemplated within the scope of the claims that the platter 102 and rotational position sensor 104 may be part of a spindle system or a rail or bearing assembly located at or adjacent to a perimeter of the platter 102. In one embodiment, a center section of the platter 102 does not rotate and is equipped with a display to provide data to a user. The display may show, for example, a number of positive (e.g., clockwise) or negative (e.g., counterclockwise) rotations from a zero position of the platter 102, a selected scale, and/or a selected octaves per rotation.

The processor 107 determines a rotational position of the platter 102 as a function of the received position signal. In one embodiment, the position signal is indicative of a change in the rotational position of the platter 102, and the processor 107 determines the rotational position of the platter 102 as a function of the change in the rotational position indicated by the position signal and a previous rotational position of the platter 102. In another embodiment, the position signal is directly indicative of the rotational position of the platter 102. That is, the rotational position sensor 104 is an encoder that provides a unique code of a plurality of unique codes, with each unique code indicative of a rotational position of the platter 102, to the processor 107. In one embodiment, the platter 102 is a turntable such as that found in modern disc jockey equipment.

The processor 107 further retrieves the sound sample from the buffer 106 and shifts a frequency of the sound sample as a function of the determined rotational position of the platter 102. In one embodiment, the processor 107 automatically tunes (i.e., frequency shifts) the sound sample to a predetermined base frequency prior to shifting the frequency of the sound sample as a function of the determined rotational position of the platter 102. In another embodiment, the processor 107 shifts the frequency of the sound sample without altering an inherent base frequency of the sound sample. As used herein, the base frequency may be an average frequency of the sound sample or a frequency at a beginning of the sound sample.

The processor 107 further renders the frequency-shifted sound sample. In one embodiment, rendering the frequency-shifted sound sample includes transforming the frequency-shifted sound sample into an analog signal and providing the analog signal to an output stage 110 of the electronic musical instrument.

In one embodiment, the electronic musical instrument 100 further includes a level control 112. The level control 112 is operable to receive a level input from the user and to provide a level signal to the processor 107, indicative of the level input received from the user. The processor 107 is operable to restart (i.e., retrigger) rendering of the frequency-shifted sound sample from the beginning of the sound sample when the level control 112 is moved from a zero position of the level control 112. It is contemplated that the zero position of the level control 112 may not be absolute zero of the level control 112. That is, electronic musical instrument 100 may account for a velocity of decrease in the level input to determine the zero position and/or may determine that values close to absolute zero of the level control 112 are sufficient to restart rendering of the frequency-shifted sound sample. That is, the electronic musical instrument 100 may have a window near zero that is determined as zero. The window varies as a function of the velocity with which the level control 112 is moved by a user toward absolute zero. The faster the level control 112 is moved toward the absolute zero position, the wider the window is. In operation, each time the level control 112 is increased rapidly from a non-zero level to near zero (i.e., absolute zero or within the variable window near zero) and back, processor 107 restarts rendering of the frequency-shifted sound sample. In one embodiment, the processor 107 is further operable to render the frequency-shifted sound sample at a volume level corresponding to the level input received at the level control 112. In one embodiment, the level control 112 is a volume fader 114, and in another embodiment, the level control 112 is a volume knob 116. It is contemplated that a single musical instrument 100 may include both a volume fader 114 and a volume knob 116 to suit the preferences of different users (i.e., operators or players). In one embodiment, the electronic musical instrument 100 includes a mode selector 172 associated with the level control 112. The mode selector 172 may be a button or two position switch operable to switch between a first mode of the level control 112 and a second mode of the level control 112. In the first mode of the level control 112, the level control 112 retriggers the sound sample as described above (i.e., restarts rendering of the sound sample from the beginning of the sound sample). In the second mode of the level control 112, the level control 112 does not retrigger the sound sample. Instead, the sound sample is retriggered or restarted by other devices, methods, and inputs as further described below (e.g., direct retrigger via a retrigger switch 120 and scrub mode wherein the time position within the sound sample is determined by a rotational position of the platter 102 within a logical division of the platter 102).

In one embodiment, the electronic musical instrument 100 also includes a retrigger switch 120. The retrigger switch is operable to receive a retrigger input from the user and provide a retrigger signal indicative of the received retrigger input. The processor 107 is operable to restart rendering the frequency-shifted sound sample as a function of the retrigger signal or in response to receiving the retrigger signal. That is, the processor 107 jumps back to the beginning of the sound sample and continues rendering the frequency shifted sound sample from the beginning. In one embodiment, the retrigger switch 120 is a button operable to be depressed by a hand or a foot of the user. The retrigger switch 120 may be a momentary contact switch that is momentarily closed upon depressing of the switch by the hand or foot of the user. The retrigger switch 120 may also be a normally closed momentary switch that is momentarily opened upon depressing of the switch by the hand or foot of the user.

In one embodiment, the musical instrument 100 has a retrigger mode (i.e., retrigger via the level control 112 or the retrigger switch 120) and a scrub mode (see below). In the retrigger mode, the processor 107 has a first render mode and a second render mode. In the first render mode, the processor 107 renders the frequency-shifted sound sample from beginning to end and stops rendering the sound sample at the end of the sound sample, assuming no retrigger event restarts rendering of the sound sample from the beginning. In the second render mode, the processor 107 renders the frequency-shifted sound sample from beginning to end and, upon reaching the end, repeats rendering the frequency shifted sound sample from the beginning. In one embodiment, the electronic musical instrument 100 includes a loop control selector 174 to select between the first render mode and the second render mode.

In one embodiment, the electronic musical instrument 100 further includes a memory 130 and a sample selector 132. The memory 130 is operable to store a plurality of sound samples. The sample selector 132 is operable to receive a sample selection input from the user selecting a sound sample of the plurality of sound samples stored in the memory 130. The sample selector 132 provides a sound sample selection signal indicative of the selected sound sample to the processor 107. The processor 107 is further operable to receive the sound sample selection signal and retrieve the selected sound sample of the plurality of sound samples from the memory 130. The processor 107 stores the retrieved selected sound sample of the plurality of sound samples in the buffer 106 for frequency shifting and rendering as described above. It is contemplated within the scope of the claims that the memory 130 and buffer 106 may be integral with one another, and that both may also be integral with the processor 107. In such an embodiment, receiving the sound sample selection signal from the sample selector 132 at the processor 107 causes the processor 107 to queue the selected sound sample for frequency shifting and rendering as described above.

In one embodiment, the electronic musical instrument 100 further includes a sample creator 140. The memory 130 is operable to store a sound stream. The sound stream may be captured from an external device via an input port or microphone of the electronic musical instrument 100, previously recorded and stored in the memory 130, imported to the memory 130 from an external storage device, or samples previously stored in the memory 130. The sample creator 140 receives sample creation input from the user selecting a start point of the sound stream and an end point of the sound stream. The sample creator 140 provides creation signals indicative of the selected start point and selected end point to the processor 107. The processor 107 receives the creation signals from the sample creator 140 and stores a portion of the sound stream between the start point and the end point in the buffer 106 as the sound sample for frequency shifting and rendering. In one embodiment, the sample creator 140 is a range slider. In one embodiment, the electronic musical instrument 100 includes a second output stage, and the processor 107 is operable to render the sound stream and provide the rendered sound stream to the second output stage such that the user can provide the sample creation input while the processor 107 is rendering the selected sound sample and providing the rendered selected sound sample to the output stage 110. For example, the second output stage may be a secondary headphone output while the output stage 110 is the primary output.

Referring to FIGS. 3A through 5C, a plurality of user-selectable example configurations of octaves per rotation of the platter 102 and logical divisions per octave are shown. For illustrative purposes, the divisions per octave are shown as musical notes. Musical notes in a scale and adjacent octaves of scales are predefined frequency differentials between one another. Therefore, although written as specific musical notes, the actual frequencies rendered by the electronic musical instrument 100 will vary as a function of the selected sound sample. It is also contemplated, that the base frequency of each selected sound sample may be varied in order to achieve particular musical notes in a particular scale or set of scales. In FIGS. 3A through 5C, octaves are delineated by solid lines, and divisions or notes within an octave are delineated by dashed or broken lines.

Referring to FIGS. 1-5C, in one embodiment, the electronic musical instrument 100 also includes a scale selector 160. The scale selector 160 is operable to receive scale selection input from the user. The scale selection input selects a scale of a plurality of scales. The scale selector is further operable to provide a scale selection signal indicative of the selected scale to the processor 107. The processor receives the scale selection signal and shifts the frequency of the sound sample as a function of the selected scale and the determined rotational position of the platter 102. The selected scale defines relative frequency shifts within an octave and between adjacent octaves. For example, FIG. 3A shows a scale having two musical notes. Selecting a next musical scale in FIG. 3B shows an 8 note scale in the octave with different logical divisions. In operation, if the platter 102 is in an 8 o'clock rotational position while the scale of FIG. 3A is selected, assuming that the sound sample has a base frequency of middle C, the frequency shift applied to the sound sample would shift the frequency of the sound sample to the frequency corresponding to a D note. When the user selects the scale corresponding to that of FIG. 3B, the frequency shift determined by the processor as a function of the selected scale and the rotational position of the platter 102 would change to a frequency shift corresponding to the frequency differential between middle C and F♯. Further, when the user selects the scale corresponding to that of FIG. 3C, the frequency shift determined by the processor is a function of the selected scale and the rotational position of the platter 102 would change to a frequency shift corresponding to the frequency differential between middle C and E. In one embodiment, the scale selector 160 comprises an array of buttons, with each button of the array corresponding to one of a plurality of scales to be applied within an octave.

Figure 4A:
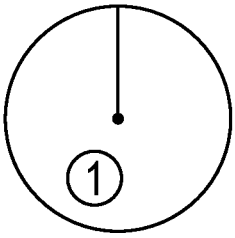
FIG. 4A is a diagram of logical divisions of a platter of the musical instrument showing a single octave per rotation.
Figure 3B:
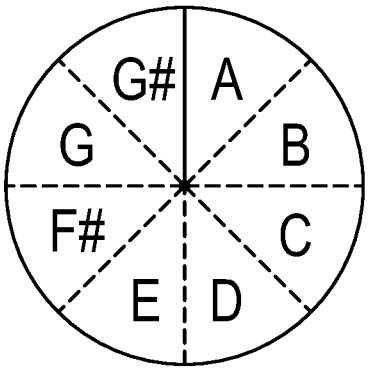
FIG. 3B is a diagram of logical divisions of a platter of the musical instrument showing eight divisions per octave and a single octave per rotation.
Figure 4B:
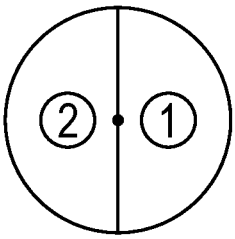
FIG. 4B is a diagram of logical divisions of a platter of the musical instrument showing two octaves per rotation.
Figure 3C:
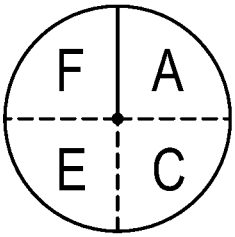
FIG. 3C is a diagram of logical divisions of a platter of the musical instrument showing four divisions per octave and a single octave per rotation.
Figure 4C:
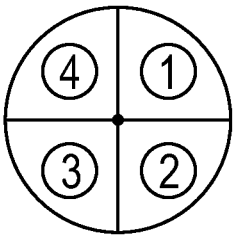
FIG. 4C is a diagram of logical divisions of a platter of the musical instrument showing four octaves per rotation.
Figure 5A:
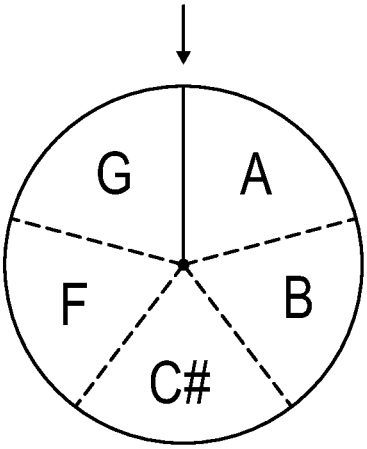
FIG. 5A is a diagram of logical divisions of a platter of the musical instrument showing five divisions per octave and a single octave per rotation.
Figure 5B:
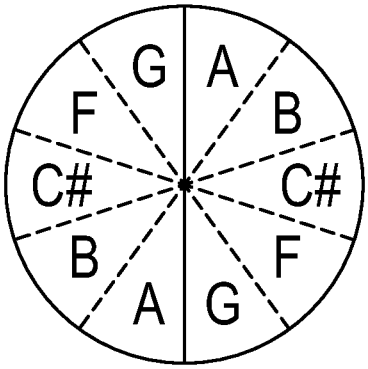
FIG. 5B is a diagram of logical divisions of a platter of the musical instrument showing five divisions per octave and two octaves per rotation.
Figure 5C:
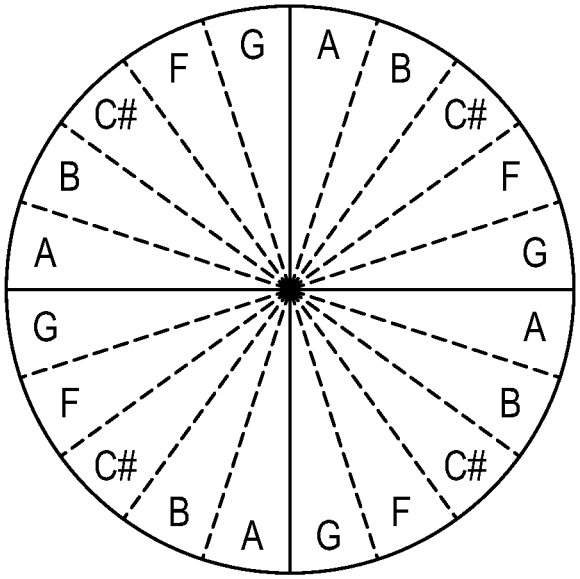
FIG. 5C is a diagram of logical divisions of a platter of the musical instrument showing five divisions per octave and four octaves per rotation.

In one embodiment, the electronic musical instrument 100 further includes an octave selector 150. The octave selector 150 is operable to receive octave selection input from the user selecting a number of octaves per rotation of the platter 102. The octave selection input 150 is further operable to provide an octave selection signal indicative of the selected number of octaves per rotation to the processor 107. The processor 107 is operable to receive the octave selection signal and shift the frequency of the sound sample as a function of the selected number of octaves per rotation and the determined rotational position of the platter 102. In operation, when the user places the platter 102 in an 8 o'clock position and selects one octave per rotation is shown in FIG. 4A, the frequency shift applied by the processor 107 to the selected sound sample corresponds to the note in the 8 o'clock position of the 1st octave above middle C. When the user selects two octaves per rotation as shown in FIG. 4B, leaving the platter 102 in the 8 o'clock position, the frequency shift applied by the processor 107 to the selected sound sample corresponds to the note in the 8 o'clock position of the second octave above middle C. When the user selects four octaves per rotation as shown in FIG. 4C, leaving the platter 102 in the 8 o'clock position, the frequency shift applied by the processor 107 to the selected sound sample corresponds to the note in the 8 o'clock position of the $3^{rd}$ octave above middle C. In one embodiment, the octave selector 150 includes an array of buttons, with each button of the array of buttons corresponding to a number of octaves per rotation of the platter 102. FIGS. 5A-5C show the octaves of FIGS. 4A-4C with a five note scale applied. Leaving the platter in the 8 o'clock position while switching from 1 to 2 to 4 octaves per rotation changes the frequency shift applied by the processor 107 to the selected sound sample from the frequency differential between middle C and F to the differential between middle C and B an octave above middle C to the differential between middle C and F two octaves above middle C.

Although described herein as shifting the frequency of the selected sound sample up from its base frequency, it is contemplated that the electronic musical instrument can also shift the base frequency of the selected sound sample down from its base frequency. This would be accomplished, for example, by rotating the platter 102 counterclockwise from a starting position corresponding to the base frequency of the selected sample.

In a retrigger mode, as described above, the electronic musical instrument 100 may restart rendering of the sound sample in response to a direct input (e.g., retrigger input 120) or a determined input or inference (e.g., level control 112 being decreased to near zero and back). In one embodiment, the electronic musical instrument also includes a scrub mode. In the scrub mode, the processor 107 is operable to render the retrieved sound sample as a function of a change in the determined rotational position of the platter 102. In the scrub mode, the length of the sample is mapped to each logical division of the platter 102. That is, the temporal length of the sound sample is mapped to a section of circumference allotted to each logical division or note. This enables the user to control the speed of the scrub through the selected sound sample at a pace determined by the user (i.e., control the playback speed of the selected sound sample via the platter 102) while also controlling the frequency shift of the selected sound sample. In this scrub mode, the sound sample may be frequency locked (i.e., "key locked") or allowed to pitch bend (i.e., analog playback mode) as selected by the user. When the frequency is locked (i.e., the base frequency of the sound sample is locked) and the user rotates the platter 102 at a rotational velocity that does not correspond to the native playback speed of the sound sample, the processor repeats or skips small sections of the sound sample to maintain the base frequency of the sound sample. The user may thus scrub backward or forward temporally through the sound sample without changing the frequency shift applied to the sound sample by the processor 107 by rotating the platter 102 to different positions within a single note (i.e., logical division).

In one embodiment, the scale selector 160 includes a notes per scale selector 162 and a key selector 164. The notes per scale selector 162 includes an array of buttons, with each button operable to select a notes per scale division (e.g., 5 notes per octave, 7 notes per octave, or 12 notes per octave). The key selector 164 also includes an array of buttons, with each button of the array corresponding to a key or base frequency of the selected scale. That is, the combination of the notes per scale selected via the notes per scale selector 162 and the key selected via the key selector 164 forms the scale selected by the scale selector 160. Although described above with reference to a base frequency of middle C for simplicity, it is contemplated that selecting a different key via the key selector 164 may shift the frame of reference for the entire frequency shift pattern implemented via the logical divisions of the platter 102. That is, the key selector 164 is operable to transpose the relative frequency shifts between logical divisions of the platter 102, and in some embodiments, may alter the base frequency of the sound sample as rendered by the processor 107.

Figure 6:
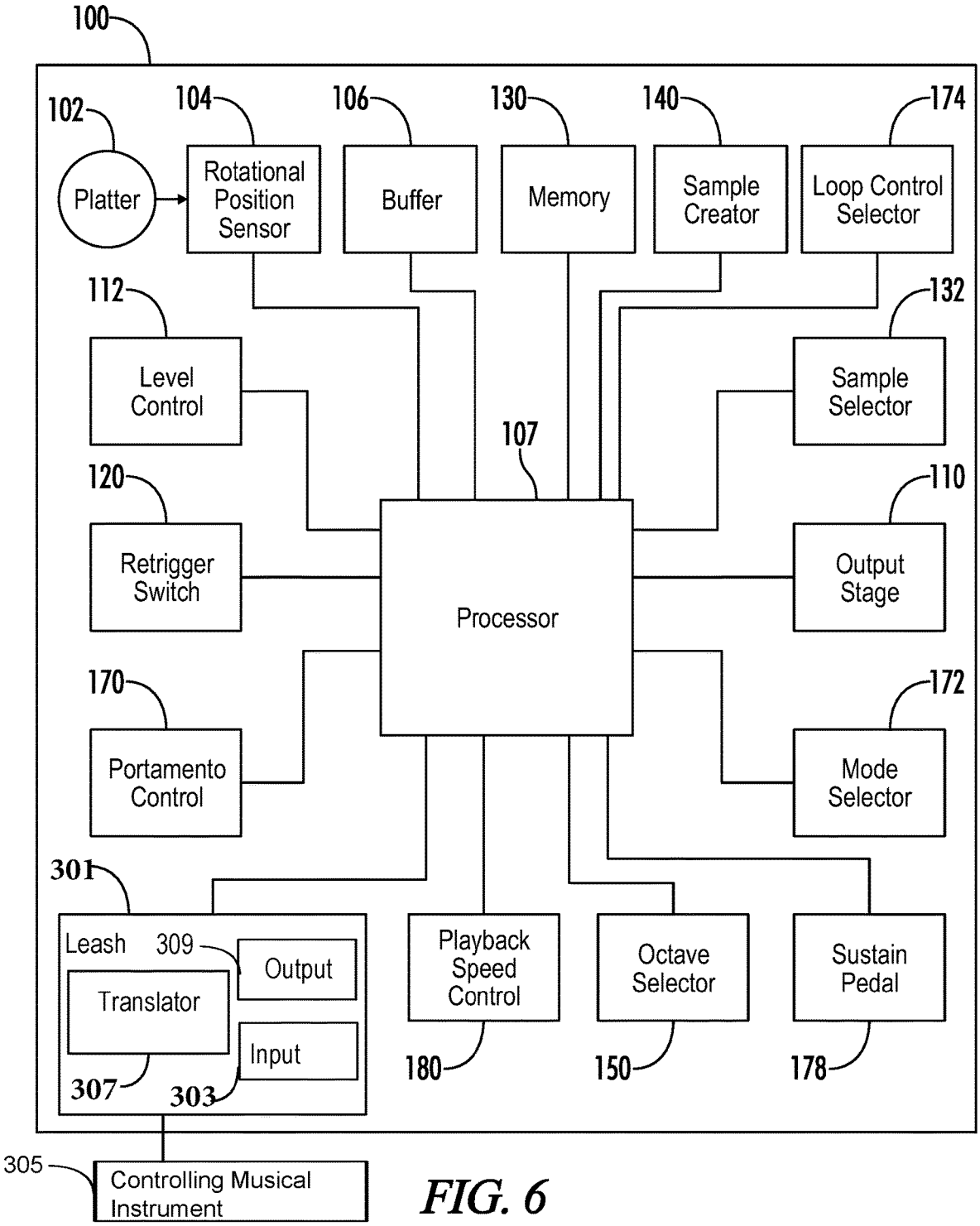
FIG. 6 is a block diagram of an electronic musical instrument, a leash, and a controlling musical instrument.

Referring to FIG. 6, in one embodiment, a leash 301 provides the scale selection signal to the platter based electronic musical instrument 100 instead of the scale selector 160. The leash 301 may also provide the octave selection signal to the electronic musical instrument 100 instead of the octave selector 150. It is contemplated within the scope of the claims that the leash may be a separate device as shown in FIG. 6, or integral with some or all of the processor 107, buffer 106, memory 130 and/or housing 190.

Playing in a band, particularly session, jazz, and blues music, typically involves key changes. For musicians coming from DJ'ing (disc jockeying) or musicians new to platter based electronic musical instruments 100, key changes can be particularly difficult to master. The leash 301 uses an input signal from a controlling musical instrument 305 to automatically input key change parameters (e.g., a scale selection signal and/or octave selection signal) to the electronic musical instrument 100. Thus, the electronic musical instrument 100 automatically changes to the appropriate key as the controlling instrument 305 changes key, and the musician operating the platter based electronic musical instrument 100 is always on key (i.e., playing in the right key) as determined by the controlling musical instrument 305. The controlling musical instrument 305 may be a keyboard, piano, guitar, or some other instrument. It is also contemplated that the controlling musical instrument 305 may be an array of instruments (e.g., a brass band) whose sound or audio outputs are collected at a single microphone or mixed together in a mixer to provide the input to the leash 301. The leash 301 includes an input 303, a translator 307, and an output 309.

In one embodiment, the second or controlling musical instrument 305 is an instrument (e.g., a keyboard) providing a musical instrument digital interface (MIDI) output. The input 303 receives the MIDI signal from the controlling musical instrument 305 and provides a corresponding digital chord signal indicative of at least one note (e.g., a chord) played on the controlling musical instrument 305 to the translator 307. In one embodiment, the input 303 is an analog input. The input signal is an analog electromagnetic signal representative of an audible sound. The input 303 is configured to digitize the analog electromagnetic signal and convert the digitized electromagnetic signal to a digital signal (e.g., a MIDI signal) representative of at least one note played on the controlling musical instrument 305. In another embodiment, the input 303 is a digital audio input, and the input signal is a pulse code modulated (PCM) stream representative of an audible sound. The input 303 is configured to decode the PCM stream and provide a digital signal representative of at least one note played on the controlling musical instrument 303 to the translator 307.

The translator 307 is operable to receive the cord signal from the input 303 and select a scale corresponding to a chord represented by the cord signal. In one embodiment, the translator is further operable to determine based on the received cord signal, a plurality of notes played on the controlling musical instrument 305 and select the scale corresponding to the cord by selecting the scale as a function of the determined plurality of notes played on the controlling musical instrument 305, said plurality of notes representative of the cord.

The output 309 is operable to provide a scale selection signal to the processor 107 of the electronic musical instrument 100 representative of the selected scale. In one embodiment, the output 309 provides the scale selection signal to the processor 107 of the electronic musical instrument 100 only when the scale selected by the translator 307 changes.

In one embodiment, a method of operating an electronic musical instrument 100 includes receiving an input signal from a controlling musical instrument 305 at the input 303 of the leash 301. A scale selection signal is provided from the output 309 of the leash 301 to the processor 107 of the electronic musical instrument 107. Electronic musical instrument 100 renders a frequency shifted sound sample, wherein the frequency shift of the frequency shifted sound sample is determined by the processor 107 is a function of a rotational position of the platter 102 of electronic musical instrument 100 and scale selection signal. In one embodiment, the method further includes providing an octave scale selection signal from the leash 301 (i.e., from the output 309 of the leash 301) to the electronic musical instrument 100 is a function of the input signal received at the leash 301.

In one embodiment, the electronic musical instrument further includes a portamento or glide control 170. When operating in the retrigger mode and transitioning between two notes or logical divisions corresponding to different frequency shifts of the sound sample, the processor 107 normally applies a discontinuous transition from a first frequency shift to a second, different frequency shift. In this operation, the slew rate is zero. The portamento control 170 is operable to change the slew rate from zero to a positive, non-zero rate. In one embodiment, the portamento control 170 provides the processor 107 a time indicative of the time in which the processor 107 should transition from the first frequency shift to the second frequency shift and the processor 107 changes the frequency shift linearly from the first frequency shift to the second frequency shift (i.e., the rate of change is variable while the time of the transition is constant). In another embodiment, the portamento control 170 provides the processor 107 a slew rate, and the processor 107 changes the frequency shift from the first frequency shift to the second frequency shift at the rate of change indicated by the portamento control 170 (i.e., the time of the transition is variable while the rate of change is constant).

In one embodiment, the musical instrument 100 further includes a playback speed control 180. The playback speed control 180 is operable to vary the rendering speed of the sound sample in the buffer 106 (i.e., the speed with which the processor 107 advances through rendering the sound sample in the buffer 106). In one embodiment, the playback speed may be adjusted positively and negatively from a native playback speed of the sound sample, and the processor 107 is operable to compensate (i.e., frequency lock or key lock) the sound sample such that the base frequency of the sound sample is not altered by the change in the playback speed.

It is contemplated within the scope of the claims that any of the buffer 106, processor 107, and memory 130 may be integral with or separate from one another. It is further contemplated that any of the components of the musical instrument 100 may be within a housing 190 of the musical instrument, or within a separate housing such as a foot-pedal housing 192. It is further contemplated that various selectors described herein may be duplicated in different locations (e.g., both the housing 190 and foot-pedal housing 192) and may be of the same or different types (e.g., momentary switches or two position switches).

In one embodiment, the electronic musical instrument 100 further includes a sustain pedal 178. The sustain pedal 178 provides a sustain signal to the processor 107. While receiving the sustain signal, the processor 107 sustains rendering of the frequency-shifted sound sample. In the retrigger mode, the electronic musical instrument 100 may play out the sound sample to the end of the sound sample or continue rendering the sound sample while fading the sound sample out, similarly to the operation of a sustain pedal of a piano. In the scrub mode, the processor 107 may repeat a small portion of the sound sample being rendered at a constant volume level when the sustain pedal 178 is activated, or the processor 107 may repeat the small portion of the sound sample being rendered at a decreasing volume level, similarly to the operation of a sustain pedal of a piano. In one embodiment, a sustain pedal selector provides input to the processor 107 for selecting between the effect of the sustain signal provided by the sustain pedal 178 to the processor 178.

It will be understood by those of skill in the art that information and signals may be represented using any of a variety of different technologies and techniques (e.g., data, instructions, commands, information, signals, bits, symbols, and chips may be represented by voltages, currents, electromagnetic waves, magnetic fields or particles, optical fields or particles, or any combination thereof). Likewise, the various illustrative logical blocks, modules, circuits, and algorithm steps described herein may be implemented as electronic hardware, computer software, or combinations of both, depending on the application and functionality. Moreover, the various logical blocks, modules, and circuits described herein may be implemented or performed with a general purpose processor (e.g., microprocessor, conventional processor, controller, microcontroller, state machine or combination of computing devices), a digital signal processor ("DSP"), an application specific integrated circuit ("ASIC"), a field programmable gate array ("FPGA") or other programmable logic device, discrete gate or transistor logic, discrete hardware components, or any combination thereof designed to perform the functions described herein. Similarly, steps of a method or process described herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, DVD, or any other form of storage medium known in the art. Although embodiments of the present invention have been described in detail, it will be understood by those skilled in the art that various modifications can be made therein without departing from the spirit and scope of the invention as set forth in the appended claims.

A controller, processor, computing device, client computing device or computer, such as described herein, includes at least one or more processors or processing units and a system memory. The controller may also include at least some form of computer readable media. By way of example and not as a limitation, computer readable media may include computer storage media and communication media. Computer readable storage media may include volatile and nonvolatile, removable and non-removable media implemented in any method or technology that enables storage of information, such as computer readable instructions, data structures, program modules, or other data. Communication media may embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful PLATTER BASED ELECTRONIC MUSICAL INSTRUMENT, it is not intended that such references be construed as limitations upon the scope of this invention except as set forth in the following

What is claimed is:

1. A leash for a platter based electronic musical instrument, wherein the electronic musical instrument is responsive to a scale selection signal to shift a frequency of a sound sample as a function of a rotational position of a platter of the electronic musical instrument and the scale selection signal, said leash comprising:

an input operable to receive an input signal from a controlling musical instrument and provide a chord signal indicative of a chord played on the controlling musical instrument, wherein:

wherein the input is an analog input, the input signal is an analog electromagnetic signal representative of an audible sound, and the input is configured to digitize the analog electromagnetic signal and convert the digitized electromagnetic signal to a digital signal representative of at least one note played on the controlling musical instrument; or the input is a digital audio input, the input signal is a pulse code modulated (PCM) stream representative of an audible sound, and the input is configured to decode the PCM stream and provide a digital signal representative of at least one note played on the controlling musical instrument;

a translator operable to:

receive the chord signal from the input; and select a scale corresponding to a chord represented by the chord signal; and an output operable to provide a scale selection signal to a processor of the electronic musical instrument representative of the selected scale.

2. The leash of claim 1, wherein the translator is further operable to:

determine, based on the received chord signal, a plurality of notes played on the controlling musical instrument; and select the scale corresponding to the chord by selecting the scale as a function of the determined plurality of notes played on the controlling musical instrument, said plurality of notes representative of the chord.

3. The leash of claim 1, wherein the input is a Musical Instrument Digital Interface (MIDI), the input signal is a MIDI signal, and the input is configured to provide a digital signal to the translator, said digital signal representative of at least one note played on the controlling musical instrument.

4. The leash of claim 1, wherein the output provides the scale selection signal to the processor of the electronic musical instrument only when the scale selected by the translator changes.

5. An electronic musical instrument comprising:

a platter operable to rotate about a center point, wherein the platter is operable to be rotated by a user;

a rotational position sensor operable to sense rotation of the platter and provide a position signal indicative of the sensed rotation of the platter;

a buffer operable to store a sound sample;

a processor operable to:

determine a rotational position of the platter as a function of the position signal;

retrieve the sound sample from the buffer;

shift a frequency of the sound sample as a function of the determined rotational position of the platter; and render the frequency-shifted sound sample; and a leash comprising:

an input operable to receive an input signal from a controlling musical instrument and provide a chord signal indicative of a chord played on the controlling musical instrument, wherein the input is an analog input, the input signal is an analog electromagnetic signal representative of an audible sound, and the input is configured to digitize the analog electromagnetic signal and convert the digitized electromagnetic signal to a digital signal representative of at least one note played on the controlling musical instrument; or the input is a digital audio input, the input signal is a pulse code modulated (PCM) stream representative of an audible sound, and the input is configured to decode the PCM stream and provide a digital signal representative of at least one note played on the controlling musical instrument;

a translator operable to:

receive the chord signal from the input;

determine, based on the received chord signal, a plurality of notes played on the controlling musical instrument; and select a scale corresponding to the determined plurality of notes played on the controlling musical instrument; and an output operable to provide a scale selection signal to the processor of the electronic musical instrument based on the selected scale, wherein the processor is further operable to receive the scale selection signal and shift the frequency of the sound sample as a function of the selected scale and the determined rotational position of the platter.

6. The electronic musical instrument of claim 5, wherein the translator is further operable to:

determine, based on the received chord signal, a plurality of notes played on the controlling musical instrument; and select the scale corresponding to the chord by selecting the scale as a function of the determined plurality of notes played on the controlling musical instrument, said plurality of notes representative of the chord.

7. The electronic musical instrument of claim 5, wherein the input is a Musical Instrument Digital Interface (MIDI), the input signal is a MIDI signal, and the input is configured to provide a digital signal to the translator, said digital signal representative of at least one note played on the controlling musical instrument.

8. The electronic musical instrument of claim 5, wherein the output provides the scale selection signal to the processor of the electronic musical instrument only when the scale selected by the translator changes.

9. The electronic musical instrument of claim 5, further comprising an octave selector operable to receive octave selection input from the user selecting a number of octaves per rotation of the platter and provide an octave selection signal indicative of the selected number of octaves per rotation to the processor, wherein the processor is further operable to receive the octave selection signal and shift the frequency of the sound sample as a function of the selected number of octaves per rotation and the determined rotational position of the platter.

10. The electronic musical instrument of claim 5, further comprising an octave selector operable to receive octave selection input from the user selecting a number of octaves per rotation of the platter and provide an octave selection signal indicative of the selected number of octaves per rotation to the processor, wherein the processor is further operable to receive the octave selection signal and shift the frequency of the sound sample as a function of the selected number of octaves per rotation and the determined rotational position of the platter, wherein the octave selector comprises an array of buttons, each button of the array of buttons corresponding to a number of octaves per rotation of the platter.

11. A method of operating an electronic musical instrument, said method comprising:

receiving an input signal from a controlling musical instrument at an input of a leash, wherein:

the input signal is an analog electromagnetic signal representative of an audible sound, and the method further comprises digitizing the analog electromagnetic signal and converting the digitized electromagnetic signal to a digital signal representative of at least one note played on the controlling musical instrument; or the input signal is a pulse code modulated (PCM) stream representative of an audible sound, and the method further comprises decoding the PCM stream and providing a digital signal representative of at least one note played on the controlling musical instrument; and providing a scale selection signal from an output of the leash to a processor of the electronic musical instrument, wherein:

the electronic musical instrument renders a frequency-shifted sound sample, wherein a frequency shift of the frequency-shifted sound sample is determined by the processor as a function of a rotational position of a platter of the electronic musical instrument and the scale selection signal.

12. The method of claim 11, further comprising:

providing an octave scale selection signal from the leash to the electronic musical instrument as a function of the input signal received at the leash.

13. The method of claim 11, further comprising:

providing sample selection input at a sample selector of the electronic musical instrument, wherein the sample selection input indicates a selected sound sample of a plurality of sound samples stored in a memory of the electronic musical instrument; and rotating a platter of the electronic musical instrument about a center point of the platter to indicate a selected frequency shift in the selected sound sample, wherein a processor of the electronic musical instrument:

retrieves the selected sound sample from a buffer of the electronic musical instrument;

shifts the frequency of the retrieved sound sample as a function of the rotational position of the platter; and renders the frequency-shifted sound sample.

* * * * *